US005093016A

United States Patent [19]

Colombo

[11] Patent Number: 5,093,016

[45] Date of Patent: Mar. 3, 1992

[54] LUBRICANT COMPOSITIONS CONTAINING NON-METALLIC DITHIOPHOSPHATES

[75] Inventor: Edilberto Colombo, Aicurzio, Italy

[73] Assignee: Presidenza del Consiglio dei Ministri Ufficio del Ministro per il Coordinamento Delle Iniziative per la Ricerca Scientifica e Tecnologica, Rome, Italy

[21] Appl. No.: 534,407

[22] Filed: Apr. 12, 1990

[30] Foreign Application Priority Data

Apr. 21, 1989 [IT] Italy ..... 20255 A/89

[51] Int. Cl.[5] ..... C10M 137/10; C10M 139/00

[52] U.S. Cl. ..... 252/32.7 E; 252/33.3; 252/37; 252/46.6; 252/49.6; 252/50; 252/52 R; 252/56 R

[58] Field of Search ..... 252/32.7 E, 33.3, 37, 252/46.3, 49.6, 50, 52 R, 56 R, 46.6

[56] References Cited

U.S. PATENT DOCUMENTS

| | | | |
|---|---|---|---|
| 2,561,773 | 7/1951 | Augustine | 252/46.6 |
| 2,565,920 | 8/1951 | Hook | 252/46.6 |
| 2,665,295 | 1/1954 | Augustine | 252/46.6 |
| 2,767,206 | 10/1956 | Whetstone | 252/46.6 |
| 3,255,111 | 6/1966 | Fields | 252/49.9 |
| 3,267,033 | 8/1966 | Allen | 252/32.5 |
| 3,574,795 | 4/1971 | Oswald | 252/46.6 |
| 3,850,822 | 11/1974 | Steere et al. | 252/46.6 |
| 3,901,932 | 8/1975 | Tada et al. | 252/46.6 |
| 4,163,729 | 8/1979 | Adams | 252/18 |
| 4,338,205 | 7/1982 | Wisotsky | 252/46.3 |
| 4,431,552 | 2/1984 | Salentene | 252/46.6 |
| 4,472,288 | 9/1984 | Frost, Jr. | 252/32.7 E |
| 4,505,829 | 3/1985 | Wisotsky | 252/32.7 E |
| 4,579,666 | 4/1986 | Schroeck | 252/32.7 E |
| 4,664,822 | 5/1987 | Hunt et al. | 252/32.7 E |
| 4,826,629 | 5/1989 | Okorodudu | 252/32.7 E |

FOREIGN PATENT DOCUMENTS

| | | |
|---|---|---|
| WO 87/07637 | 12/1987 | PCT Int'l Appl. . |
| 1329978 | 9/1973 | United Kingdom . |

OTHER PUBLICATIONS

Oswald et al., General Papers, Division of Petroleum Chemistry, American Chemical Society, vol. 8, No. 1, Mar. 1963, pp. 5–19.

*Primary Examiner*—Margaret Medley
*Attorney, Agent, or Firm*—Oblon, Spivak, McClelland, Maier & Neustadt

[57] ABSTRACT

This invention relates to lubricant compositions containing both zinc O,O'-dialkyldithiophosphates and ashless O,O'-diaryldithiophosphates obtained by reacting an O,O'-diaryldithiophosphoric acid with a diolefin. These lubricant compositions give improved anti-wear performance.

6 Claims, No Drawings

LUBRICANT COMPOSITIONS CONTAINING NON-METALLIC DITHIOPHOSPHATES

This invention relates to lubricant compositions containing both zinc O,O'-dialkyldithiophosphates and ashless O,O'-diaryldithiophosphates of high thermal stability. These additives result in lubricant compositions with very high anti-wear activity.

Zinc dialkyldithiophosphates are the most well known anti-wear additives and are used universally not only because of their activity but also because of their flexibility. In this respect they are able to behave simultaneously both as antioxidants and anticorrosives.

For some time there has however been a tendency to use fluid lubricants in such a manner as to reduce fuel consumption, even though a reduction in the thickness of the oil film results. Under severe lubrication conditions this thickness reduction leads to an increase in the probability of rupture of the protective oil film and consequently an increase in wear. To ensure proper operation of the lubricant system there is therefore a requirement for additives with high anti-wear characteristics, a requirement which the metallic dithiophosphates generally used in an engine oil do not seem able to satisfy, probably because of their relatively low thermal stability.

This problem cannot be solved by increasing the amount of additive, and in fact this must be avoided because it would lead to interaction with the detergent system and would increase the ash content, resulting in undesirable pre-ignition.

It has now been found that lubricant compositions containing both zinc O,O'-dialkyldithiophosphates and ashless O,O'-diaryldithiophosphate of high thermal stability provide the higher anti-wear performance required from these types of more fluid lubricant.

The present invention therefore provides lubricant compositions containing from 0.5 to 1.5% of a zinc O,O'-dialkyldithiophosphate and from 0.3 to 1.0% of an ashless O,O'-diaryldithiophosphate obtained in a two-step process consisting of:

A) reacting with $P_2S_5$ a phenol of formula ArOH, where Ar is a mono or polyalkylsubstituted phenyl in which the alkyl substituents contain from 4 to 24 carbon atoms and can be linear or branched, to give the corresponding O,O'-diaryldithiophosphoric acid $(ArO)_2PSSH$;

B) adding the O,O'-diaryldithiophosphoric acid obtained from the preceding step to a diene chosen from norbornadiene, cyclopentadiene and bicyclopentadiene.

The phenol used in the first step is preferably chosen from p-dodecylphenol and p-nonylphenol.

Step A consists of heating at least 4 moles of the phenol ArOH to a temperature of between 55° and 150° C. and then adding 1 mole of $P_2S_5$ in small portions.

When the addition is complete the reaction mixture is maintained at the same temperature until hydrogen sulphide evolvement ceases, generally within one hour.

In step B the diaryldithiophosphoric acid obtained is reacted with a diene chosen from cyclopentadiene, bicyclopentadiene and norbornadiene. Specifically, the reaction is conducted with equimolecular quantities if the diene is bicyclopentadiene and it is required to obtain the products deriving from adding the O,O'-diaryldithiophosphoric acid to only one of the two double bonds present in the molecule. If the diene is chosen from norbornadiene, cyclopentadiene and bicyclopentadiene and it is required to obtain the products deriving from adding the O,O'-diaryldithiophosphoric acid to both the double bonds present in the molecule the molar quantity of O,O'-diaryldithiophosphoric acid used is at least double that of the diene.

The reaction can be conducted without solvent or in the presence of a solvent such as hexane, heptane, cyclohexane or toluene. The chosen diene compound is added to the diaryldithiophosphoric acid in small portions to control the exothermic effect of the reaction in such a manner as to maintain the temperature between 25° and 140° C. according to the type of diene.

On termination of the addition the reaction can be completed, if necessary, by heating further for about 1 hour.

Specifically, the present invention provides lubricant formulations having the following composition:

1) from 55.0 to 65.0% of a mineral oil
2) from 8.0 to 12.0% of a polyolefin
3) from 8.0 to 12.0% of a carbonic or carboxyl ester
4) from 5.5 to 6.5% of an ethylene-propylene copolymer
5) from 5.5 to 6.5% of a polymethacrylate
6) from 3.5 to 4.5% of a polyisobutenylsuccinimide borate
7) from 2.0 to 3.0% of a neutral calcium and/or magnesium sulphonate
8) from 1.0 to 2.0% of a superbasic calcium and/or magnesium sulphonate
9) from 1.0 to 1.5% of a zinc dithiophosphate
10) from 0.2 to 0.4% of an aromatic amine
11) from 0.2 to 0.4% of a sterically hindered phenol
12) from 0.3 to 1.0% of an ashless diaryldithiophosphate obtained by reacting $(ArO)_2PSSH$ with a diene chosen from norbornadiene, cyclopentadiene and bicyclopentadiene, under the conditions described heretofore.

These formulations were subjected to engine tests to evaluate their anti-wear properties in comparison with the results obtainable from the same mixture but without the additive. The OM616-KOMBITEST, M102E and HKL engine tests were used. The first of these evaluates the wear at the cam-rocker arm and cylinder-piston contact surfaces. The CCMC specification defines the following values for this test:

average wear = 1.5 μm/1000 km max wear = 3.0 μm/1000 km where these values are measured on the cam.

The second test evaluates lubricant performance with regard both to controlling sludge formation and to evaluating the wear expressed as deformation of the cam profile.

The third test, the HKL test, evaluates the wear of the transmission contact surface under conditions which simulate engine operation under idling conditions. The wear is measured on the cam and rocker arm.

Specifically, the tests were implemented on a formulation containing 0.5% of an ashless diaryldithiophosphate obtained by reacting p-dodecylphenol with $P_2S_5$ and then reacting the O,O'-di(p-dodecylphenyl)-dithiophosphoric acid thus obtained with norbornadiene. This formulation was compared with the same formulation but without the addition of the ashless dithiophosphate.

The results obtained in the first test are as follows:

| | reference formulation | formulation with (II) added |
|---|---|---|
| average wear μm/1000 km | 1.8 | 0.4 |
| maximum wear μm/1000 km | 3.5 | 0.9 |

The following results were obtained in the second test:

| | reference formulation | formulation with (II) added |
|---|---|---|
| sludge score | 9 | 9.2 |
| average wear μm | 65 | 20 |
| maximum wear μm | 80 | 30 |

In the third test, the HKL, the extent of wear expressed in μm/100 hours was as follows:

| | reference formulation | formulation with (II) added |
|---|---|---|
| cam wear | 29 | 22 |
| rocker arm wear | 4 | 2 |

All these tests prove the greater anti-wear efficiency of the lubricant compositions according to the present invention containing both zinc O,O'-dialkyldithiophosphates and ashless O,O'-diaryldithiophosphates.

EXAMPLE 1

88 g (0.4 moles) of p-nonylphenol are fed into a 4-neck flask and heated to about 120° C. 22.2 g (0.1 mole) of $P_2S_5$ are then added in small portions over 3 hours. The mixture is then heated for a further one hour until the reaction is complete. 6.0 g of cyclopentadiene deriving from the thermal cracking of bicyclopentadiene at 140° C. are then added to 100 g of the obtained acid (P=5.3%, total acid number TAN=100 mg KOH/g) in such a manner as to control the exothermic effect of the reaction. On termination of the addition the reaction mixture is kept stirring for 1 hour at 50°-70° C. until the reaction is complete. The product obtained (P=5.0%) has a copper compatibility evaluated by the ASTM D130 test (3 hours, 121° C.) of 1b and a thermal stability (by PDSC) of 318° C.

EXAMPLE 2

104.8 g of p-dodecylphenol are reacted with 22.2 g of $P_2S_5$ at 150° C. for 3 hours. 100 g of the O,O'-didodecylphenyl-dithiophosphoric acid obtained (P=5.0%, TAN=74 mg KOH/g) are dissolved in 100 ml of toluene and treated with 6 g of 2,5-norbornadiene. The reaction is complete in 2 hours. The solvent is removed by distillation and the recrystallized product (P=4.8%) has a copper compatibility evaluated by the ASTM D130 test (3 hours, 121° C.) of 1b and a thermal stability (by PDSC) of 320° C.

I claim:

1. A lubricant composition with anti-wear activity comprising a lubricant and from 0.5 to 1.5% of a zinc O,O'-dialkyldithiophosphate and from 0.3 to 1.0% of an ashless O,O'-diaryldithiophosphate obtained by a two-step process consisting of: A) reacting with $P_2S_5$ a phenol of formula ArOH, where Ar is a mono or polyalkyl-substituted phenyl in which the alkyl substituents contain from 4 to 24 carbon atoms and can be linear or branched, to give the corresponding O,O'-diaryldithiophosphoric acid $(ArO)_2PSSH$, B) adding the O,O'-diaryldithiophosphoric acid obtained from the preceding step to a diene chosen from norbornadiene, cyclopentadiene and bicyclopentadiene.

2. A lubricant composition comprising:
a) from 55.0 to 65.0% of mineral oil
b) from 8.0 to 12.0% of polyolefin
c) from 8.0 to 12.0% of carbonic or carboxyl ester
d) from 5.5 to 6.5% of ethylene-propylene copolymer
e) from 5.5 to 6.5% of polymethacrylate
f) from 3.5 to 4.5% of polyisobutenylsuccinimide borate
g) from 2.0 to 3.0% of neutral calcium and/or magnesium sulphonate
h) from 1.0 to 2.0% of superbasic calcium and/or magnesium sulphonate
i) from 1.0 to 1.5% of zinc dithiophosphate
l) from 0.2 to 0.4% of aromatic amine
m) from 0.2 to 0.4% of sterically hindered phenol
n) from 0.3 to 1.0% of an ashless diaryldithiophosphate obtained by a two-step process consisting of: A) reacting with $P_2S_5$ a phenol of formula ArOH, where Ar is a mono or polyalkylsubstituted phenyl in which the alkyl substituents contain from 4 to 24 carbon atoms and can be linear or branched, to give the corresponding O,O'-diaryldithiophosphoric acid $(ArO)_2PSSH$, B) adding the O,O'-diaryldithiophosphoric acid obtained from the preceding step to a diene chosen from norbornadiene, cyclopentadiene and bicyclopentadiene.

3. A lubricant composition as claimed in claim 1, wherein in step A the molar ratio of phenol to $P_2S_5$ is at least 4 and in step B the molar ratio of O,O'-diaryldithiophosphoric acid to diene is at least stoichiometric.

4. A lubricant composition as claimed in claim 1, wherein the phenol of formula ArOH used in step A is p-nonylphenol or p-dodecylphenol.

5. A lubricant composition as claimed in claim 1, wherein the ashless dithiophosphate is obtained by reacting p-dodecylphenol with $P_2S_5$ and then reacting the O,O'-di(p-dodecylphenyl)dithiophosphoric acid obtained with norbornadiene.

6. A lubricant composition as claimed in claim 5, wherein the concentration of the ashless diaryldithiophosphate is 0.5%.

* * * * *